United States Patent [19]

Yamaguchi

[11] 4,124,049

[45] Nov. 7, 1978

[54] FOLDABLE TANK FOR CONTAINING LIQUIDS

[75] Inventor: Miyoichi Yamaguchi, Yokohama, Japan

[73] Assignee: Nippon Hanpu Kogyo Co., Ltd., Yokohama, Japan

[21] Appl. No.: 689,338

[22] Filed: May 24, 1976

[30] Foreign Application Priority Data

Apr. 13, 1976 [JP] Japan ..... 51-45737[U]

[51] Int. Cl.[2] ..... B65D 33/38

[52] U.S. Cl. ..... 150/0.5; 150/8; 222/107; 222/530

[58] Field of Search ..... 150/0.5, 1, 8; 4/177; 222/107, 528, 530

[56] References Cited

U.S. PATENT DOCUMENTS

| | | | |
|---|---|---|---|
| 2,529,872 | 11/1950 | Hasselquist | 150/0.5 UX |
| 2,566,838 | 9/1951 | Hurt | 150/8 |
| 2,633,172 | 3/1953 | Treiber | 150/0.5 |
| 2,854,049 | 9/1958 | Wyllie | 150/0.5 UX |
| 2,957,614 | 10/1960 | Krajcovic | 222/530 X |

FOREIGN PATENT DOCUMENTS

| | | | |
|---|---|---|---|
| 1,340,983 | 9/1963 | France | 150/8 |

*Primary Examiner*—Donald F. Norton
*Attorney, Agent, or Firm*—Irving M. Weiner

[57] ABSTRACT

A foldable liquid tank is provided for storing water, fire extinguishing fluid, or other liquids. The tank can be folded to a small size for convenient transportation and housing thereof. When filled with liquid, the tank takes the shape of a truncated globoid, the normal shape of the contained liquid in the form of a water drop by the pressure of the contained liquid.

3 Claims, 15 Drawing Figures

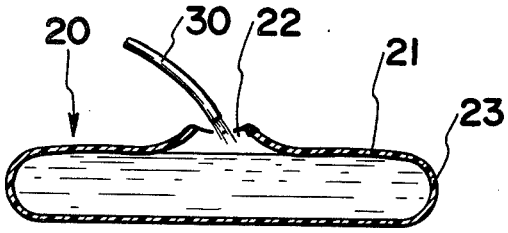
FIG. 5
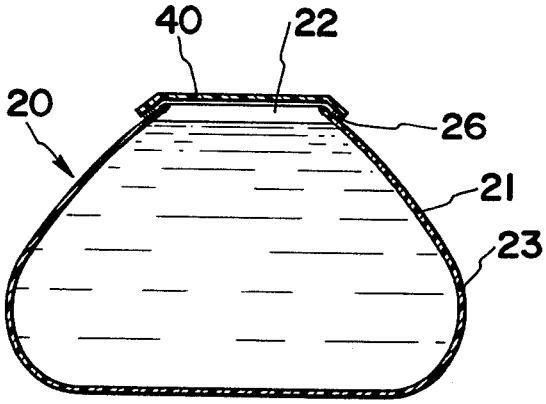
FIG. 6
FIG. 7
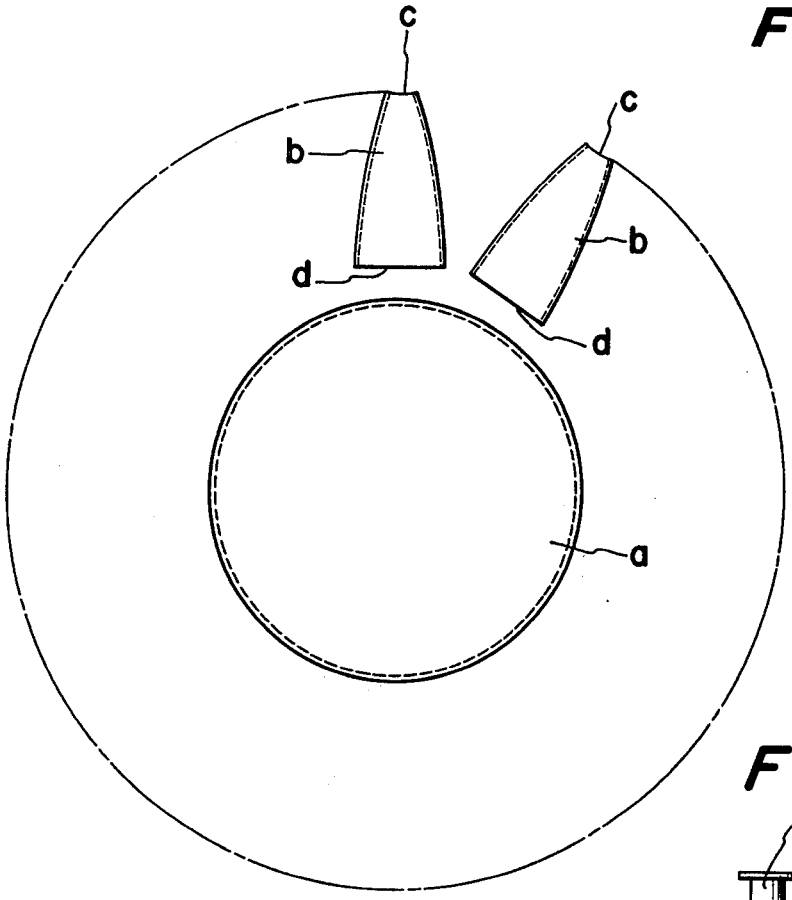
FIG. 8
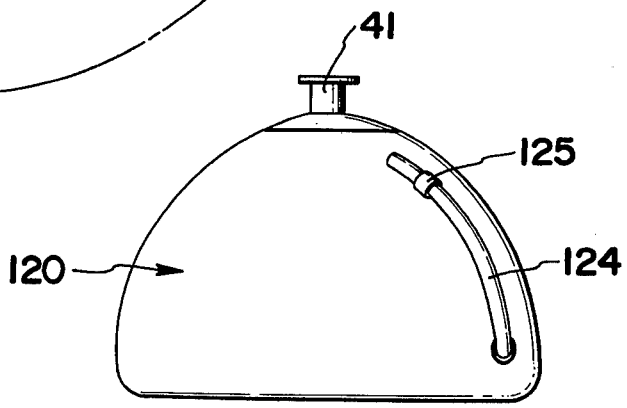

FIG. 9
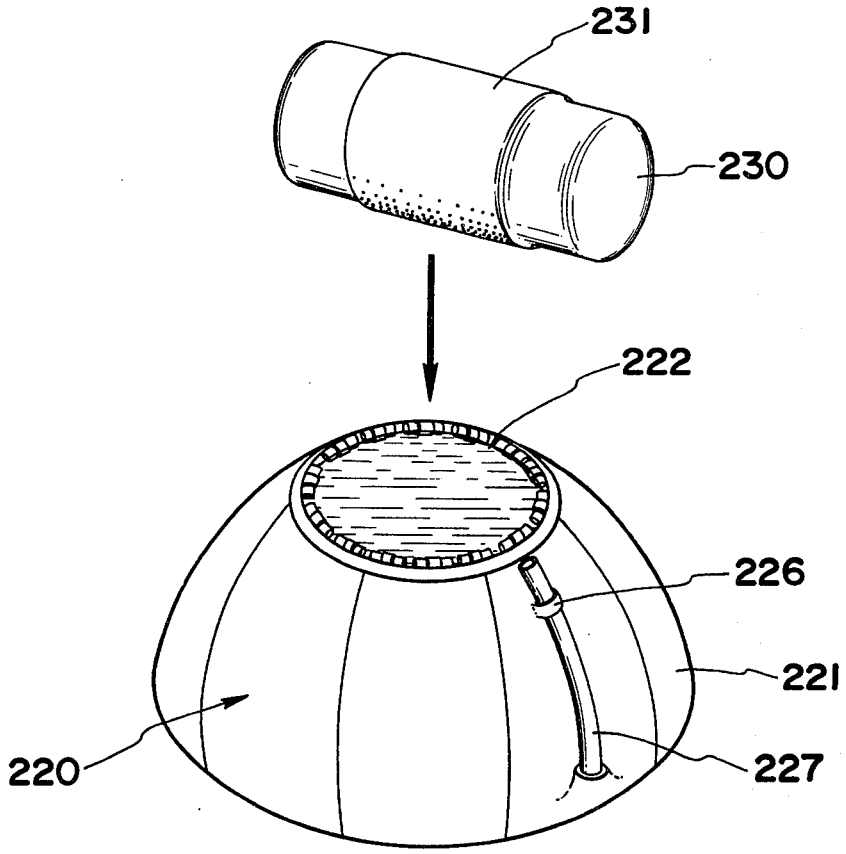
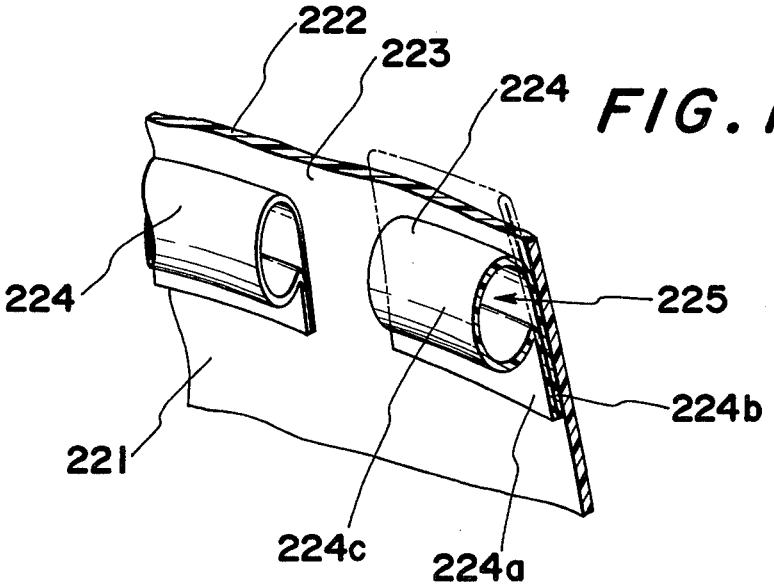
FIG. 10

FOLDABLE TANK FOR CONTAINING LIQUIDS

BACKGROUND OF THE INVENTION

1. Field of the Inventionz

The present invention relates to foldable liquid tanks and more particularly to a water tank which can be folded to be as small as possible in size and to be convenient to carry and house. The water tank according to the invention can be set up for use to contain water can be made in the shape of a truncated globoid, the normal shape of the contained liquid in the form of a water drop by the pressure of the contained water; and can be used as a water tank for drinking water or fire extinguishing water or as a liquid tank for a fire extinguishing agent.

2. Description of the Prior Art

A conventional foldable water tank for storing drinking water or fire extinguishing water is constructed by forming a water tank body cylindrically of canvas or the like; fitting a frame made of pipes or the like around the body; and surrounding the periphery of the body with bands to maintain the contour of the tank.

Such a conventional tank as above described is too troublesome and time consuming to assemble to be used as a foldable water tank such as for storing drinking water at the time of a disaster or to be used as a fire extinguishing water tank or the like. Such a water tank is complicated in structure has many component parts, is very high in cost, and is generally not acceptable.

The present invention eliminates such various problems of the conventional foldable water tank as are mentioned above and effectively solves all such problems by providing an efficient, inexpensive, and easy to use tank.

SUMMARY OF THE INVENTION

The present invention provides a foldable tank for containing liquids. The tank includes a main bag shaped body portion of suitable flexible and waterproof material which is in the shape of a truncated globoid the normal shape of the contained liquid, when filled with liquid. The main body portion includes a peripheral wall formed by water-tightly overlapping and connecting fan-shaped sheets and a bottom wall formed by a circular sheet. The lower edges of the peripheral wall are water-tightly secured to the bottom wall and the upper edges of the peripheral wall form a liquid inlet port. A liquid outlet port is provided in the peripheral wall. The tank is especially useful for containing water and preferably the main bag shaped body portion is flexible. The peripheral wall is formed by fan-shaped sheets of the same material in a manner as above described.

An object of the present invention is to provide a simple and convenient water tank which is foldable, can be folded to be as small as possible in size and to be very convenient to carry and house, can be conveniently set up for use, can be automatically inflated in the shape of a truncated globoid, the normal shape of the contained water, by merely pouring water through a hose to store a fixed amount of water and can be used as a tank for drinking water, fire extinguishing water or a fire extinguishing agent. Particularly, the present invention provides a water tank which can contain a large amount of water or other liquid with a thin sheet by utilizing the self-form retaining property of water, that is, the tendency of water to be in the form of a water drop under surface tension.

A further object of the present invention is to provide a water tank which is provided with many floats inside the peripheral edge of a water inlet port so that the peripheral wall of the water inlet port may be prevented from partly dropping at the time of pouring or taking out water and may always retain a fixed form by the buoyancy of the floats, can thereby positively prevent water from flowing out while retaining the foldable and developable functions, can be easily handled, and is higher in practicability.

Another object of the present invention is to provide a water tank wherein a sheet-shaped anchoring part having two slots formed in it is fixed on both sides to the peripheral wall of the water tank so as to be fitted to the water tank. A hose collapsed to be flat is inserted and held in this anchoring part so as to be fixed very simply while maintaining the foldable function of the water tank and positively preventing water from flowing out through the hose.

A further object of the present invention is to provide a water tank wherein a sheet-shaped lid formed of a flexible material having a surface area larger than that of a water inlet port and lighter than water is inserted in a foldable water tank so as to float on the water surface when water is poured in through the water inlet port. The lid thus will positively seal the water inlet port of the water tank with the water pressure when the tank is filled with water. Thus, a lid means is provided having a foldable function with a very simple formation which positively prevents water from leaking out at the time of transportation.

Other objects and details of the invention will become apparent from the following description, when read in conjunction with the accompanying drawings.

BRIEF DESCRIPTION OF THE DRAWINGS

FIG. 5 illustrates a side view of the embodiment of FIG. 2.

FIG. 6 depicts a side view of the embodiment of FIG. 4 as fitted with a lid.

FIG. 7 shows a developed view of respective members forming a water tank according to the invention.

FIG. 8 illustrates a side view of a water tank according to the present invention provided with a mouthpiece.

FIG. 9 depicts a perspective view of a water tank according to another embodiment of the invention having floats and a magnified perspective view of the float.

FIG. 10 is a magnified perspective view of a float fitting part according to the invention.

DETAILED DESCRIPTION OF SOME PREFERRED EMBODIMENTS OF THE PRESENT INVENTION

Figure 1:
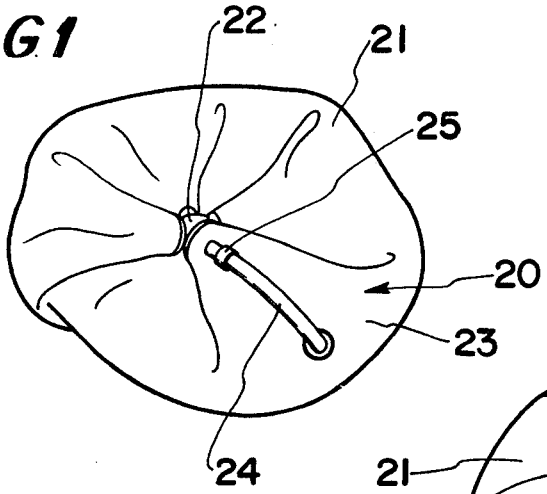
FIG. 1 illustrates a perspective view of a water tank as folded.
Figure 2:
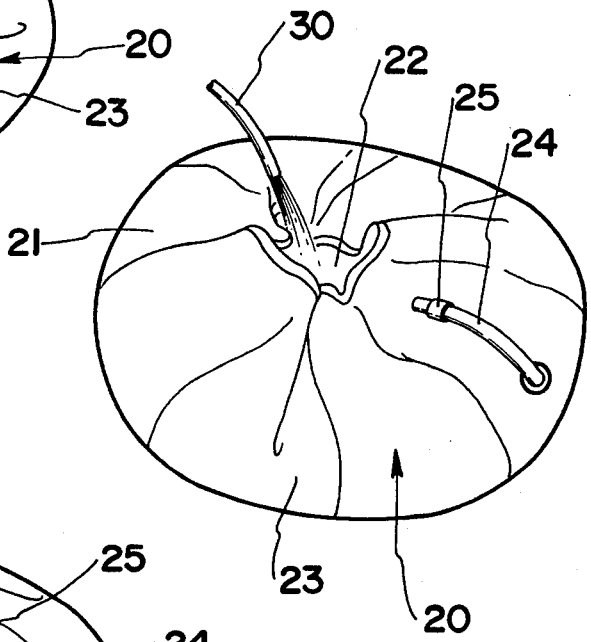
FIG. 2 depicts a perspective view of the water tank of FIG. 1 as initially filled with water.
Figure 3:
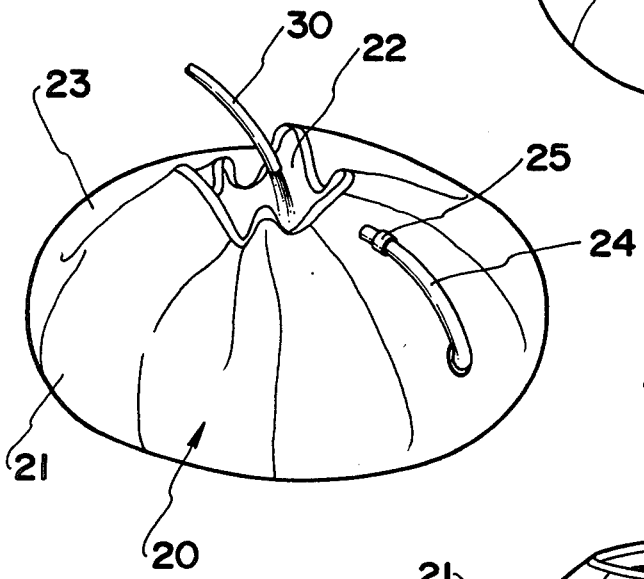
FIG. 3 illustrates a perspective view of the water tank of FIG. 1 as intermediately filled with water.
Figure 4:
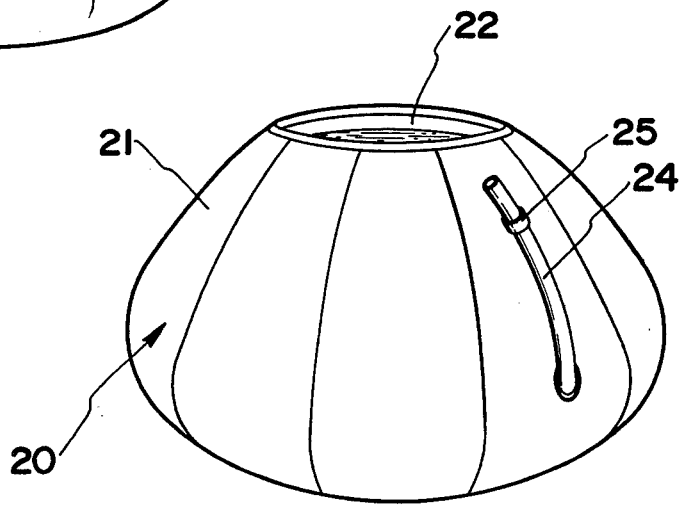
FIG. 4 depicts a perspective view of the water tank of FIG. 1 as completely filled with water.

FIG. 1 shows a water tank 20 according to the present invention as developed for use. FIG. 2 shows the same as filled with water through a hose 30. FIG. 3 shows the same as inflated with the charge of water. FIG. 4 shows the same as filled completely with water.

The water tank 20 according to the present invention is formed to be in the shape of a truncated globoid bag body 21 by integrally seaming and welding flexible sheets which are waterproof such as, for example, a Tetoron or Dacron canvas so as to be foldable and evelopable. The truncated globoid bag body 21 is opened in the top part to form a water inlet port 22. A hose 24 made of the same flexible material, or rubber or vinyl, is water-tightly connected to the base part with the lower side of a portion of the peripheral wall 23 so as to open inside the the wall to form a water outlet port. A belt-shaped anchoring part 25 holding the hose 24 in the tip part is formed in the upper side part of the peripheral wall 23 with which the hose 24 is connected in the base part so as to hold the hose 24 along the peripheral wall and prevent the discharge of water even when the tank is completely filled with water, except when water is to be taken out.

In the water tank 20 as shown in FIG. 7, a bottom piece *a* is formed by circularly cutting such sheet as Tetoron or Dacron canvas having a flexibility and waterproofness. A required number of fan-shaped peripheral pieces *b* of the same material are formed so as to surround the above-mentioned bottom piece *a*. The fan-shaped peripheral pieces *b* are cut in the respective top part *c* as curved inward so as to form the above-mentioned inlet port 22 and are formed in the bottom parts *d* to be straight.

The above-mentioned peripheral pieces *b* are arranged radially in the bottom parts *d* on the peripheral edge of the bottom piece *a*, are overlapped in the bottom parts *d* on the peripheral edge of this bottom piece *a*, are water-tightly seamed together with a high frequency welder, are then overlapped at both side edges on each other and are water-tightly seamed in the same manner so as to form the above-mentioned bag body 21. The above-mentioned hose 24 and ring-shaped hose anchoring part 25 are integrally connected with one of the peripheral pieces.

The above-formed bag body 21 is formed of a flexible sheet member and therefore can be folded to be small in size so as to be housed or carried conveniently when it is not used and can be developed for use as in the above-mentioned FIG. 1 embodiment when it is required. Then, as shown in FIG. 2, a water hose 30 or the like is inserted into the inlet port 22 in the top part, water is poured into the bag body 21 and this state is shown in section in FIG. 5. The peripheral wall 23 will be pushed, expanded and inflated gradually by the surface tension and pressure of water poured into the bag body 21 so as to form the truncated globoid water tank 20 having the inlet port 22 opened in the top part as shown in FIG. 4 when the bag body is filled with water. This state is shown in section in FIG. 6. Thus, the flexible sheet will be inflated by the pressure of water. By this inflation, the sheet formed as mentioned above will be fed with water to be contained. The water will be supported by the side wall so as to be in the form of a water drop. Therefore, the water pressure will be applied inward and downward. The water has a self-form retaining property while retaining the form of the water tank and therefore even a thin sheet can endure a large water pressure.

In the embodiment in FIGS. 1 to 4, no lid is provided in the inlet port of the water tank 20. However, as shown in FIG. 6, a fastener 26 can be provided on the outer periphery of the inlet port 22 and a lid 40 formed of the same sheet can be connected with the inlet port 22 so that the water tank may be used to store drinking water.

In the case of using water in the water tank 20, when the hose 24 is removed from the anchoring part 25 and is directed downward, the water contained in the tank will be discharged by the water pressure.

The above embodiment shows an open type water tank. FIG. 8 shows a sealed type water tank 120 wherein a cylindrical mouthpiece 41 free to open and close is fitted to the top part of the water tank 20 so as to be opened to pour water into the tank. The remainder of the formation is exactly the same as in the above-mentioned embodiment and a hose 124 and a band 125 are provided.

Thus, the present invention provides a water tank which has a bag body 21 forming a water tank 20 formed of a flexible sheet, can be therefore folded, can be housed and carried as compactly as possible in size and, as required, can be transported to a destination, developed on the spot and filled with water so as to be in the shape of a truncated globoid, the normal shape of the contained water,. Therefore, it can be used as a water tank for securing and supplying drinking water at the time of a disaster or for storing fire extinguishing water or as a tank for storing a fire extinguishing agent. Further, it can be prepared to be used at home at the time of a disaster and is convenient.

The work for forming the water tank requires no special assemblying work at all. By merely connecting the inlet port with a water faucet through a hose or the like and feeding water to charge the tank, a truncated globoid water tank can be automatically formed. The work is simple, the structure can be formed by seaming a sheet material and is therefore simple. The water tank can be obtained at a low cost in quantities, can be easily used even at home, is in the form of a truncated spheroid and can store a large amount of water as compared with the dimension due to the tear drop effect, that is, the action of the sheet of the water tank to cover water.

FIG. 9 shows an embodiment wherein the water tank 20 is provided with floats. That is to say, as the water tank 20 of the present invention is formed of a flexible sheet, in the process of developing the folded water tank as in FIG. 1, pouring water into the tank through the water inlet port by means of a hose as in FIG. 2, and inflating the tank gradually with the water pressure as in FIG. 3 until it is completely filled with water as in FIG. 4, a problem is likely to be produced in retaining the peripheral wall of the water inlet port in a fixed form and the peripheral wall is likely to drop in a part so that water may flow out through such part. Further, even when water is to be taken out to discharge the water tank, the peripheral wall of the water inlet port will be likely to drop in the same manner with the gradual reduction of the amount of water and the height of the water surface so that water may flow out in the same manner as mentioned above. Therefore, in the present invention, many sheet-shaped float holders 224 made by bending and overlapping sheets molded of the same material as shown in FIG. 10 are provided on the inside part 223 of the peripheral edge of a water inlet port 222 formed in the top part of a bag body 221. This float holder 224 is integrally welded by means of a high frequency welder or the like to the bag body 221 with both end parts 224*a* and 224*b* directed downwardly of the bag body 221 and overlapped on each other while leaving the intermediate part 224*c* unwelded so that a loop-shaped holder part 225 may be thereby formed in the intermediate part 224*c*. In the case of folding and housing the bag body 221, the holder parts 225 are pushed and collapsed so that the bag body 221 may be as small as possible.

FIG. 9 shows a float 230 to be inserted into the holder part 22. This float 230 is molded to be in the form of a short column of material lighter than water as, for example, a foaming styrol. A large diameter part 231 having an outside diameter fitting the inside diameter of the holder part 225 is formed in the middle part of the outer periphery of the float. The outside surface of this large diameter part is made so rough that, when the large diameter part 231 of the float 230 is inserted into the holder part 225, the float may be prevented by friction from dropping. Further, the float 230 is formed removably from the holder part 225.

In the case that the bag body 221 formed as in the above is to be used as a water tank 220, when the folded and housed bag body 221 is developed for use as mentioned above, floats 230 are inserted and set in the respective holder parts 225 of the many float holders 224 provided on the peripheral wall of the water inlet port 222 and water is poured in through the water inlet port 222. The bag body 221 will be gradually inflated by the water pressure, the floats 230 will be floated on the water surface by their buoyancy, and as a result, the peripheral wall of the water inlet port 222 will always retain the fixed inlet port form under the action of the floats without partly dropping and will positively prevent water from flowing out. Water will thus be able to be poured in until the water tank of the bag body 221 is completely filled with water.

In case water in the water tank is to be used, when the hose 227 is removed from the anchoring part 226 and water is discharged by the water pressure, the height of the water surface will lower with the reduction of the amount of water in the water tank and the floats 230 will also lower with it while keeping the peripheral wall of the water inlet port 222 in a fixed form and while preventing water from flowing out through the water inlet port 222 until the discharge of all water is completed. When the discharge of water is completed and the water tank is to be housed, the floats 230 are pulled out of the respective float holders 6, the holder parts are pushed and collapsed, and the water tank is folded to be small in size and is housed.

In the above embodiment, the floats 230 are formed to be removable from the respective float holders 224. However, in case the water tank is folded, if the floats 230 are not in the way, they may be fixed directly to the water inlet port 222. In the illustrated embodiment, the float 230 is in the form of a column of foaming styrol but can be made of not only this material but also any other suitable material and in any other suitable form. The holder part 225 can be also set so as to fit the form of the float.

Figure 11:
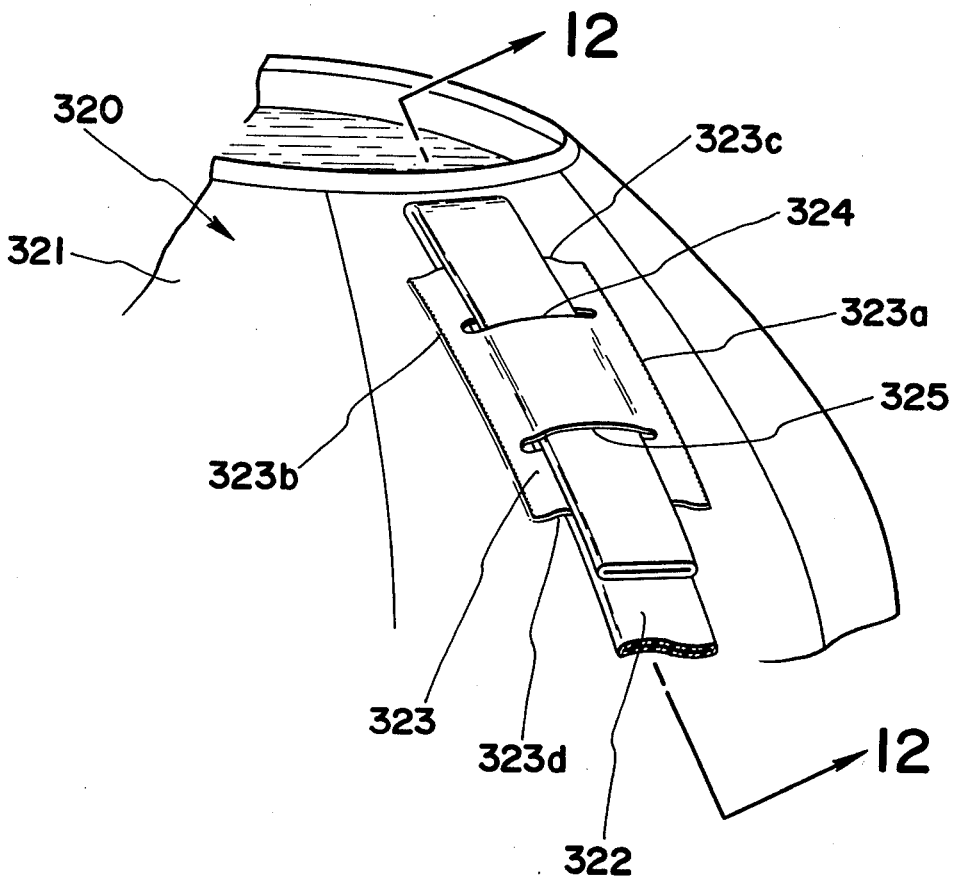
FIG. 11 illustrates a magnified perspective view of a hose fitting part according to the invention.
Figure 12:
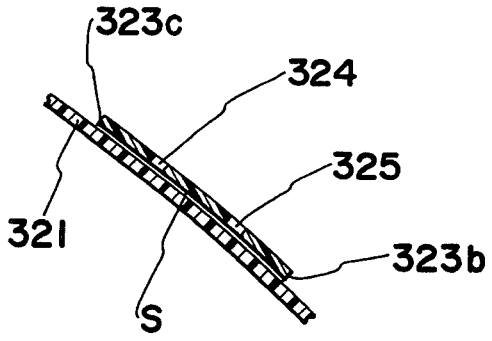
FIG. 12 depicts a section view along the line 12—12 shown in FIG. 11 showing the hose fitting part.

FIGS. 11 and 12 show an embodiment wherein the water tank is made easier to fold and the hose is positively fitted. That is to say, in the present invention, the water tank is foldably formed so as to be very convenient to house and carry. Therefore, in the case of providing a hose for discharging and taking out water, a means of anchoring this hose when it is not used will be required. In consideration of the above-mentioned foldability, it is preferable that this anchoring means be formed of a very simple structure and can simply anchor the hose, and that the anchoring part itself also have a foldable function. The anchoring means is also required to have a function of positively preventing water from flowing out through the hose when the water tank is full of water. A water discharging hose 322 is fitted to the lower part of the peripheral wall of a bag body 321 forming a water tank 320 so that, in case water in the bag body 321 is to be used for such various uses as extinguishing fire and drinking, water may be discharged through the hose 322. An anchoring part 323 for the hose 322 is provided above the hose 322 on the peripheral wall of the bag body 321. This anchoring part 323 is formed of a square sheet molded of the same material as of the bag body 321. As shown in FIGS. 11 and 12, this sheet is fixed on both sides 323*a* and 323*b* to the peripheral wall of the bag body 321 in the same manner by welding with a high frequency welder or the like but is not welded and is left open on the upper and lower sides 323*c* and 323*d* so as to thereby form a gap S between the peripheral wall of the bag body 321 and the back surface of the middle part of the anchoring part 323 formed of the sheet. Two slots 324 and 325 each having a length rather larger than the lateral width of the hose 322 when pushed and collapsed to be flat are made parallel above and below in this anchoring part 323.

The hose 322 is collapsed to be flat, is inserted in the front end part through the upper and lower open parts 323*c* and 323*d* of the anchoring part 323, is turned downward, is inserted at the turned end through the slot 324 and is pulled out through the slot 325 so that the hose 322 may be thereby anchored as in FIG. 11, with the hose 322 thus being slidably disposed adjacent the free end thereof within each of the slots 324, 325. In case the tank is full of water while the hose is thus anchored, the hose may be pressed and collapsed by the inflated peripheral wall and may not be removed from this part.

Figure 13:
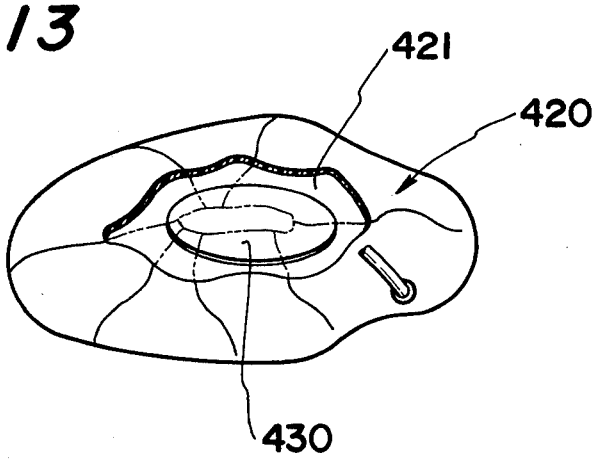
FIG. 13 illustrates a partly sectioned perspective view of a tank as fitted inside with a sheet-shaped lid when initially filled with water.
Figure 14:
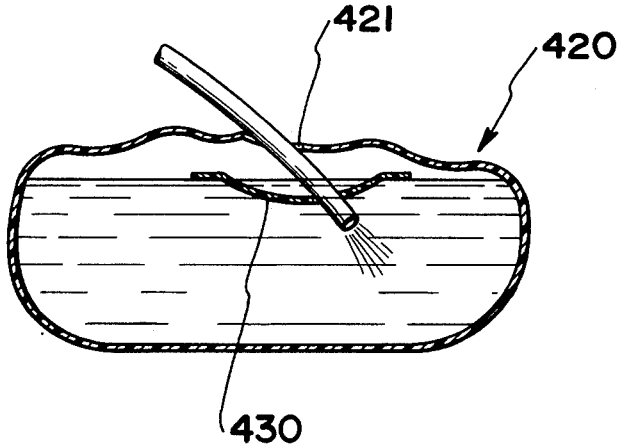
FIG. 14 depicts a sectioned side view of the embodiment shown in FIG. 13.
Figure 15:
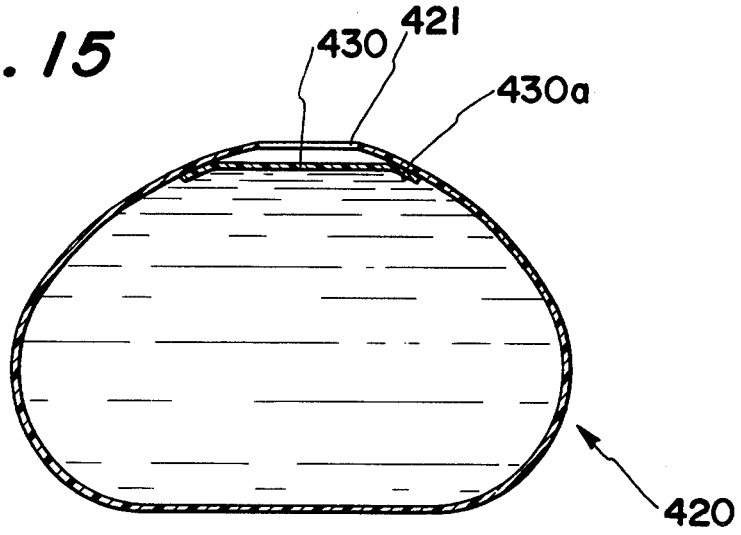
FIG. 15 illustrates a sectioned side view of the FIG. 13 embodiment as completely filled with water.

FIGS. 13 to 15 show an embodiment wherein a lid is provided. In consideration of using water in the water tank for drinking, as mentioned above, such engaging means as a fastener is provided on the periphery of the water inlet port and a lid is removably fitted and engaged on it so that dust may be prevented from entering the water tank and the water in the tank may be well used for drinking. In the case of transporting the water tank full of water, the water will be likely to leak out, the above mentioned lid means will not be a positive sealing means, the peripheral wall of the water tank will flex even when the tank is full of water, the lid will be very difficult to engage and the lid fitting work will be troublesome. Further, since this water tank has a foldable function as mentioned above, the lid also must have a foldable function. Therefore, a lid means which is very simple in formation, has a foldable function, and is a positive sealing means is desired.

As shown in FIG. 13, a circular lid 430 set to be of a diameter larger than the inside diameter of a water inlet port 421 is inserted in advance into a water tank 420. This lid 430 is formed of a sheet-shaped material which is not detrimental to human beings, is lighter than water and has characteristics of waterproofness and flexibility. Thereby, as shown in FIG. 14, when water is poured into the water tank 420 through the water inlet port 421, the flat water tank 420 will be gradually inflated by the water pressure, and at the same time, the lid 430 inserted and contained in the water tank will float and rise toward the water inlet port 421 with the increase of the amount of water, while floating on the water surface. When the water tank 420 becomes full of water, as shown in FIG. 15, the lid 430 will be brought in close contact on the peripheral part 430*a* with the inside peripheral wall of the water inlet port 421 by the water pressure so as to prevent dust from being mixed into water in the water tank 420, to hygienically protect the water and to prevent the water from leaking out of the water tank.

When the water tank 420 thus completely filled with water and sealed with the lid 430 was transported to be actually tested, the water in the water tank did not leak out, the lid did not open, very favorable results were obtained and its practicability was proved.

The above lid 430 is made circular in the illustration but, as explained in the above, the lid may be brought into close contact on the peripheral part with the inside peripheral wall of the water inlet port 421 by the water pressure and therefore, if the lid has a surface area larger than the area of the water inlet port 421, the lid 430 will not be limited to be circular in shape but will be able to be selected to be of any suitable shape. Further, the surface of the lid 430 to be in contact with the inside peripheral surface of the water inlet port can be made rough so that the friction with the inside peripheral wall of the water tank may be so large as to further improve the close contact.

The present invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description. Furthermore, all changes which come within the meaning and range of equivalency of the appended claims are therefore intended to be embraced therein.

I claim:

1. A foldable tank for containing liquids, comprising:

a main bag shaped body portion of suitable flexible and waterproof material, said main body portion being in the shape of a truncated globoid when filled with liquid to take the normal shape of the contained liquid;

said main body portion including a peripheral wall formed by water-tightly overlapping and connecting peripheral pieces, and a bottom wall formed by a circular sheet;

the lower edges of said peripheral wall being water-tightly secured to said bottom wall, and the upper edges of said peripheral wall forming a liquid inlet port;

a liquid outlet port being provided in said peripheral wall;

a sheet having two slots therein affixed on two sides to said peripheral wall of said main body portion for providing an anchoring portion;

said sheet being molded of a flexible material; and a liquid discharge hose secured at one end thereof to said outlet port, said discharge hose being anchored in said anchoring portion formed by said sheet, with said hose being slidably disposed adjacent the free end thereof within each of said slots.

2. A foldable tank characterized substantially in accordance with claim 1, wherein:

said sheet having said slots therein is molded from a square sheet of the same material as said main body portion so as to provide a foldable anchoring portion; and said sheet is welded on said two sides thereof to said peripheral wall of said main body portion.

3. A foldable tank for containing liquids, comprising:

a main bag shaped body portion of suitable flexible and waterproof material, said main body portion being in the shape of a truncated globoid when filled with liquid to take the normal shape of the contained liquid;

said main body portion including a peripheral wall formed by water-tightly overlapping and connecting peripheral pieces, and a bottom wall formed by a circular sheet;

the lower edges of said peripheral wall being water-tightly secured to said bottom wall, and the upper edges of said peripheral wall forming a liquid inlet port;

a liquid outlet port being provided in said peripheral wall;

said liquid inlet port being provided with a sheet-shaped lid formed of a flexible material lighter than water and having a surface area larger than the area of said liquid inlet port; and said lid being inserted in the top of said main body portion for sealing the liquid inlet port when said main body portion is filled with liquid.

* * * * *